US007179213B1

(12) United States Patent
Kuo et al.

(10) Patent No.: US 7,179,213 B1
(45) Date of Patent: Feb. 20, 2007

(54) FOLDING COLLAPSIBLE EXERCISING MACHINE

(76) Inventors: Johnson Kuo, 5F., No. 6, Lane 12, Sec. 6, Hsin I Rd., Taipei (TW); Chin-Lien Huang, No. 194, Hsiu Tsai Rd., Yang Mei Chen, Taoyuan Hsien (TW)

( * ) Notice: Subject to any disclaimer, the term of this patent is extended or adjusted under 35 U.S.C. 154(b) by 0 days.

(21) Appl. No.: 11/158,088

(22) Filed: Jun. 22, 2005

(51) Int. Cl.
*A63B 26/00* (2006.01)

(52) U.S. Cl. ..... 482/140; 482/91; 482/907

(58) Field of Classification Search ..... 482/140, 482/91, 92–93, 907; D21/662, 665, 686, D21/687
See application file for complete search history.

(56) References Cited

U.S. PATENT DOCUMENTS 5,632,710 A * 5/1997 England et al. ..... 482/127
6,234,942 B1 * 5/2001 Yang ..... 482/132
6,352,495 B1 * 3/2002 Hsu ..... 482/92
7,070,548 B2 * 7/2006 Thonn, Jr. ..... 482/142
2004/0209751 A1 * 10/2004 Thonn, Jr. ..... 482/140
2004/0220026 A1 * 11/2004 Stearns ..... 482/140
2004/0220027 A1 * 11/2004 Stearns ..... 482/140

* cited by examiner

*Primary Examiner*—Lori Amerson
(74) *Attorney, Agent, or Firm*—Troxell Law Office, PLLC

(57) ABSTRACT

A folding collapsible exercising machine includes a base frame that can rock on the floor and is provided with a seat pad, two damping spring members adjustably mounted in the base frame for adjusting damping resistance to the base frame during operation of the exercising machine to rock the base frame on the floor, a T-shaped leg extension bar pivoted to the base frame and locked in the operative position with a detachable lock screw, and a collapsible handlebar provided at the top side of the T-shaped leg extension bar.

1 Claim, 17 Drawing Sheets

FOLDING COLLAPSIBLE EXERCISING MACHINE

BACKGROUND AND SUMMARY OF THE INVENTION

The present invention relates to exercising machines and more particularly, to a folding collapsible exercising machine practical for exercising sit-up and legs press to exercise the muscles of the legs and the abdomen.

FIGS. 1~3 show a conventional sit-up exercising machine 8. This exercising machine is still not satisfactory in function because of the following drawbacks:

1. The first support bar 81 and the second support bar 82 are set close to each other and the first support bar 81 can only be turned outwards (see FIG. 2). Therefore, this design of exercising machine is limited to sit-up exercise, not practical for back-bend or other exercises. Further, when the first support bar 81 is turned outwards, the machine requires much space.

2. This machine does not allow the user to adjust the damping resistance to fit different users.

3. Because the first support bar 81 is a curved bar, it is inconvenient and requires much effort to hold the first support bar 81 in position such that the pivot hole 811 at one end of the first support bar 81 is aligned between two opposite pivot holes 8011 and 8012 at an upright lug 801 at the base frame 80 of the exercising machine 8 for the mounting of a pivot pin 802.

4. After each use, the user must turn the first support bar 81 outwards to get free from the constraint of the machine.

Therefore, it is desirable to provide an exercising machine that eliminates the aforesaid drawbacks.

The present invention has been accomplished under the circumstances in view. It is therefore one object of the present invention to provide a folding collapsible exercising machine, which is practical for exercising various exercises including sit-up, leg-lift, and back-bend. It is another object of the present invention to provide a folding collapsible exercising machine, which is convenient in use and allows the user to leave after exercise without changing the arrangement of the machine. It is still another object of the present invention to provide a folding collapsible exercising machine, which is adjustable to provide different damping resistance to fit different requirements. To achieve these and other objects of the present invention, the folding collapsible exercising machine comprises a base frame that can rock on the floor and is provided with a seat pad, two damping spring members adjustably mounted in the base frame for adjusting damping resistance to the base frame during operation of the exercising machine to rock the base frame on the floor, a T-shaped leg extension bar vertically provided at the rear side of the base frame for supporting the user's legs during exercise, and a collapsible handlebar provided at the top side of the T-shaped leg extension bar. Further, the T-shaped leg extension bar is pivoted to the base frame and locked in the operative position with a detachable lock screw. After removal of the lock screw, the T-shaped leg extension bar and the handlebar can be received to the base frame to save storage space.

DETAILED DESCRIPTION OF THE INVENTION

Figure 1:
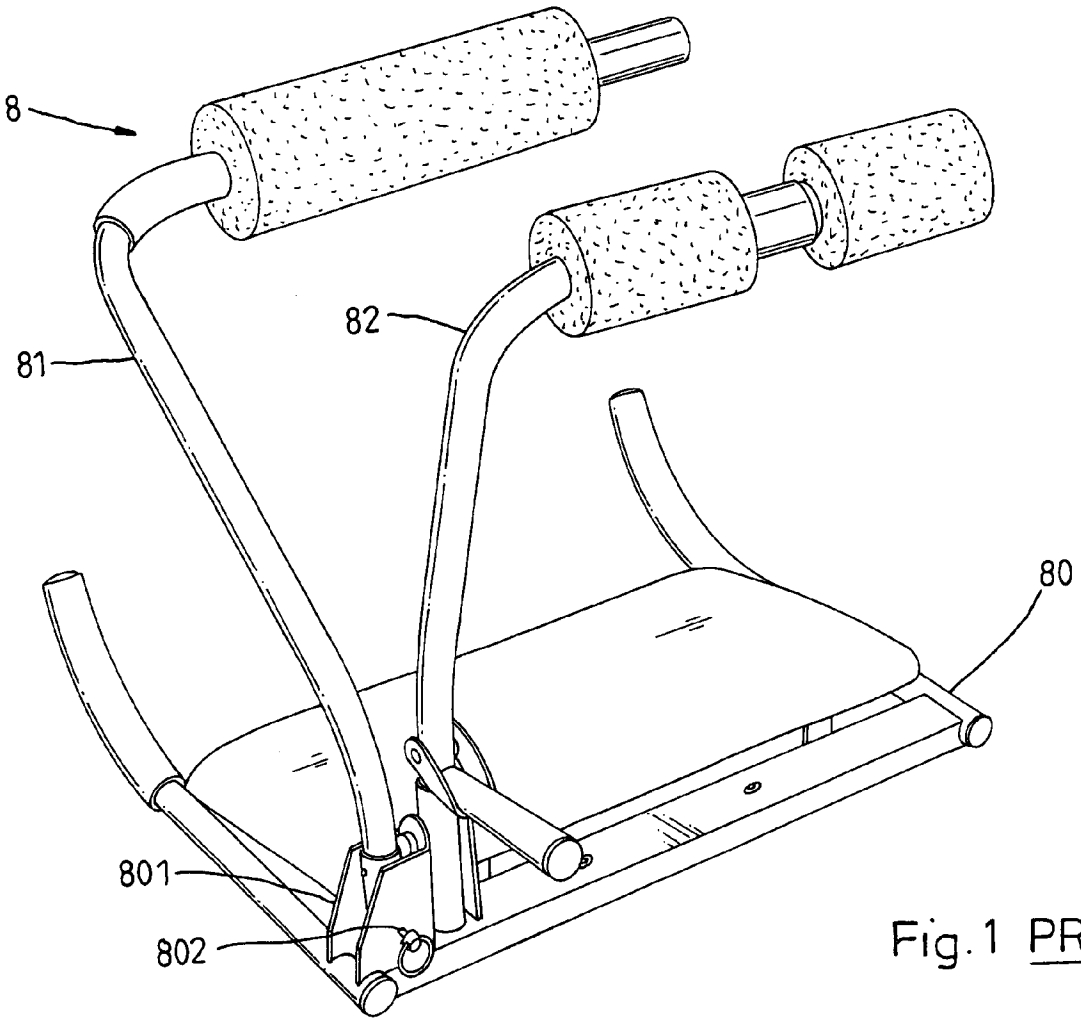
Fig. 1 PRIOR ART
FIG. 1 is an elevational view of a sit-up exercising machine according to the prior art.
Figure 2:
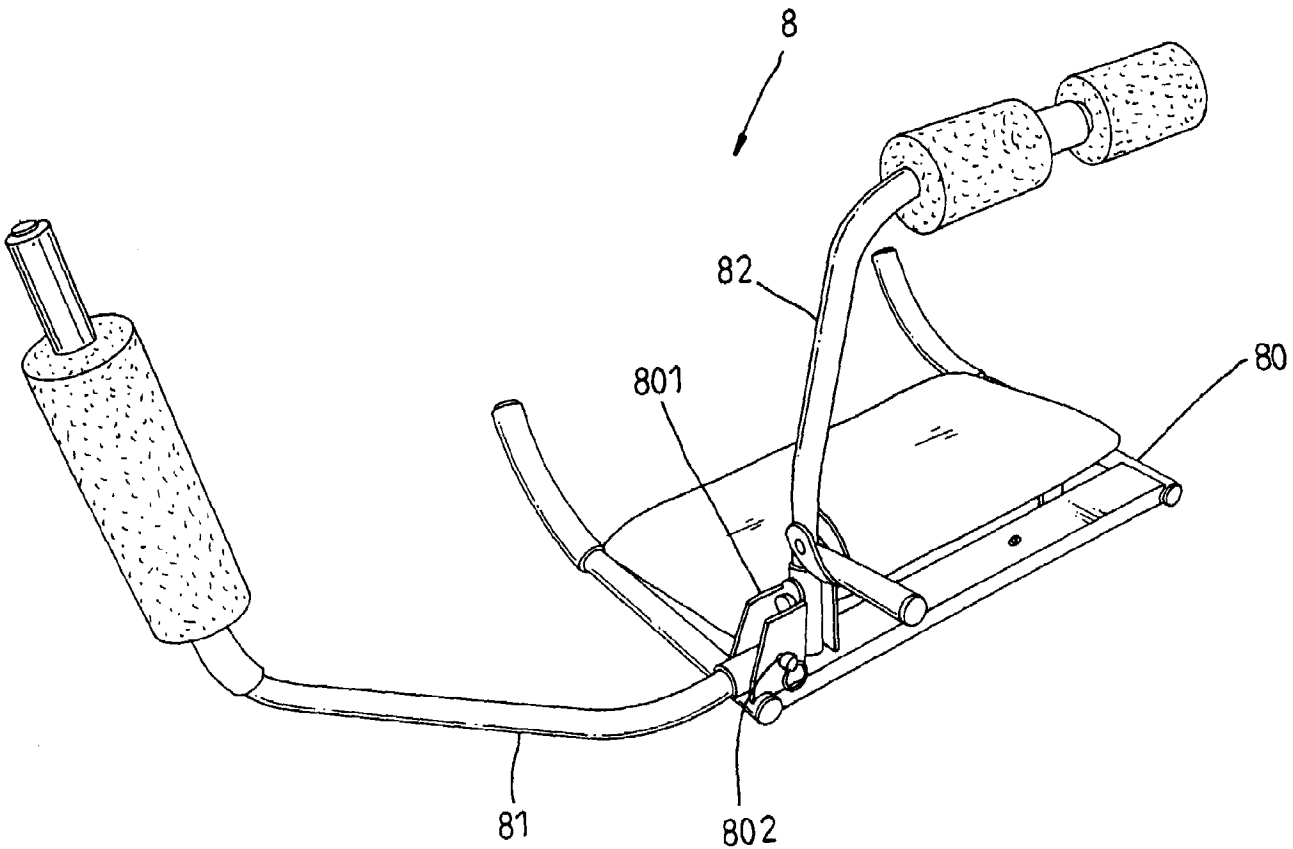
Fig. 2 PRIOR ART
FIG. 2 corresponds to FIG. 1, showing the first support bar turned outwards.
Figure 3:
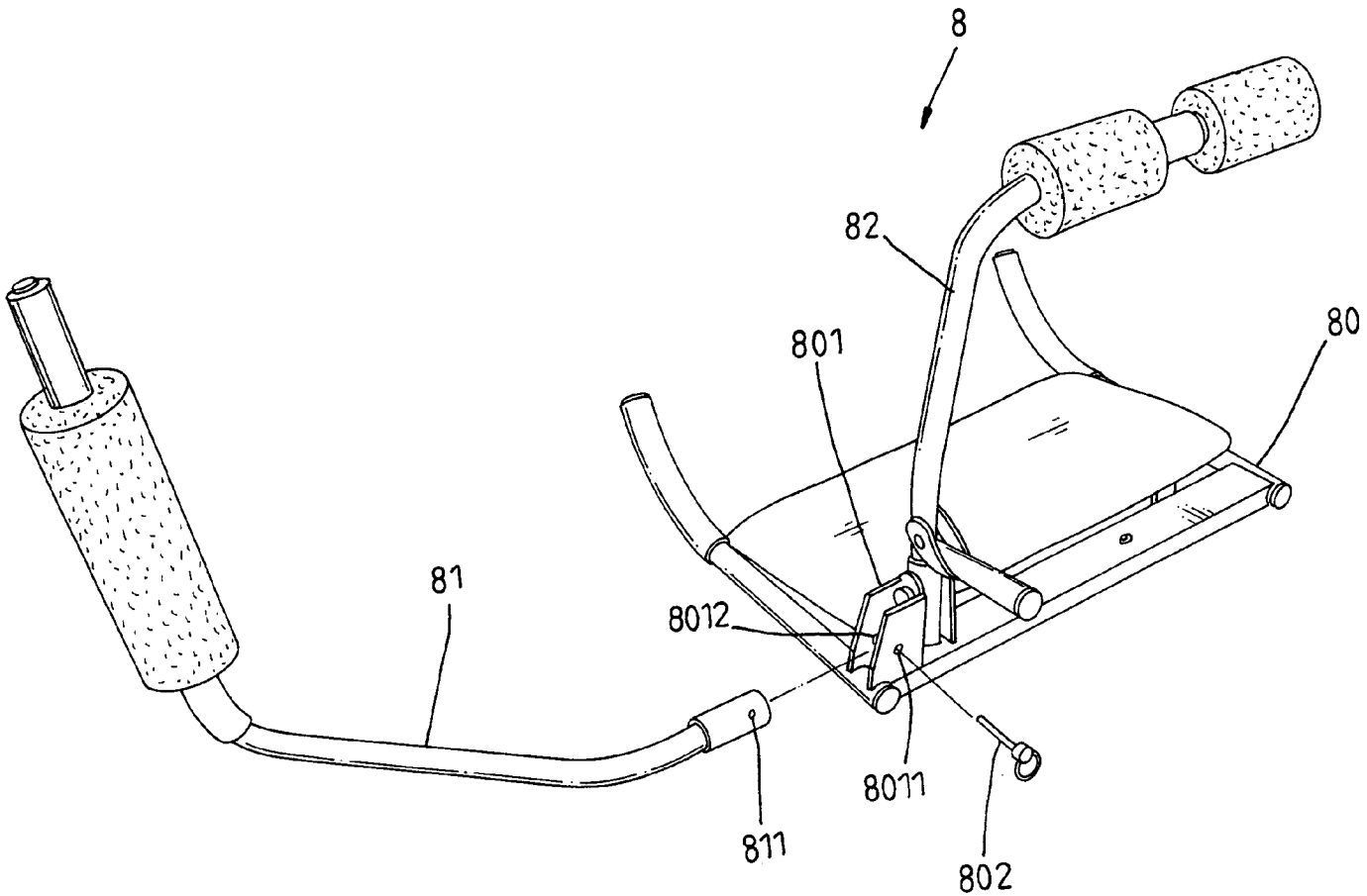
Fig. 3 PRIOR ART
FIG. 3 is an exploded view of the sit-up exercising machine according to the prior art.
Figure 4:
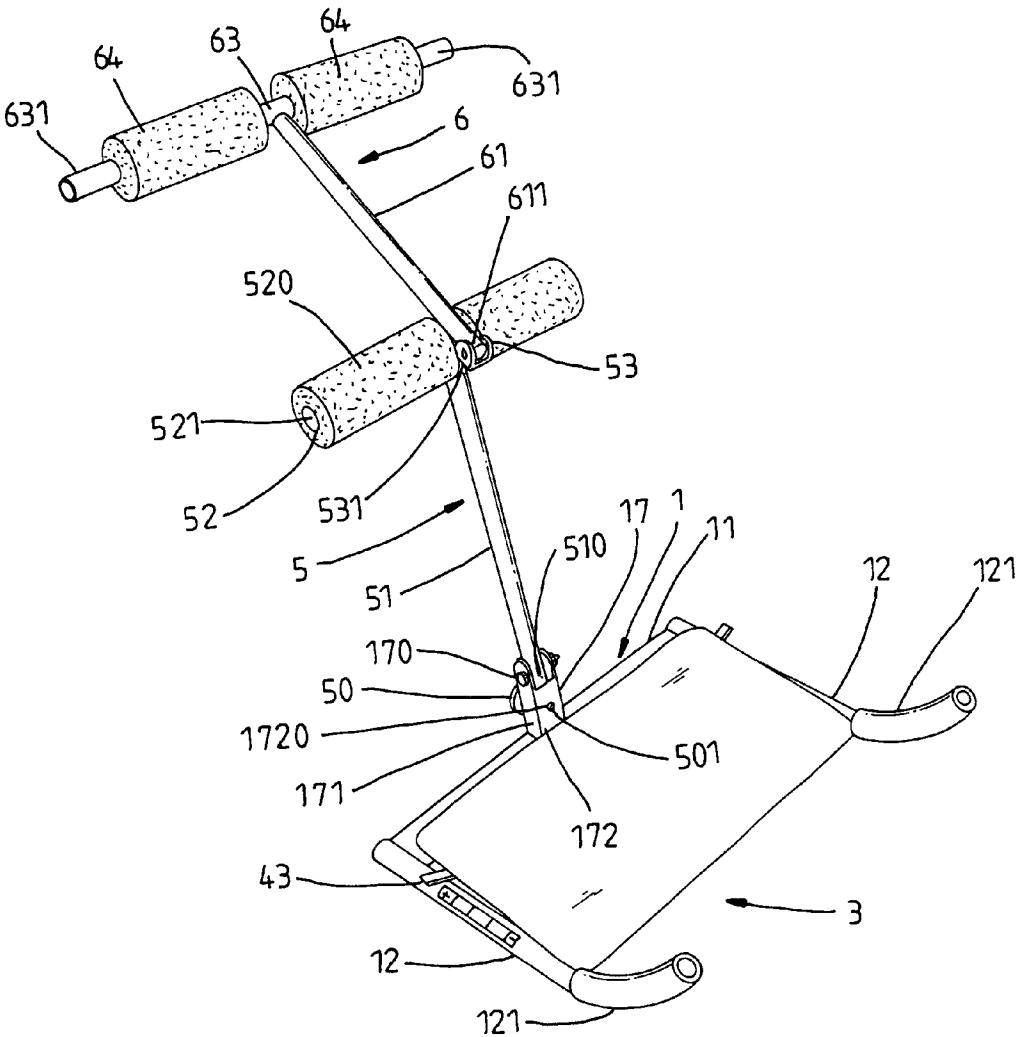
FIG. 4 is an oblique front elevation of a folding collapsible exercising machine according to the present invention.
Figure 5:
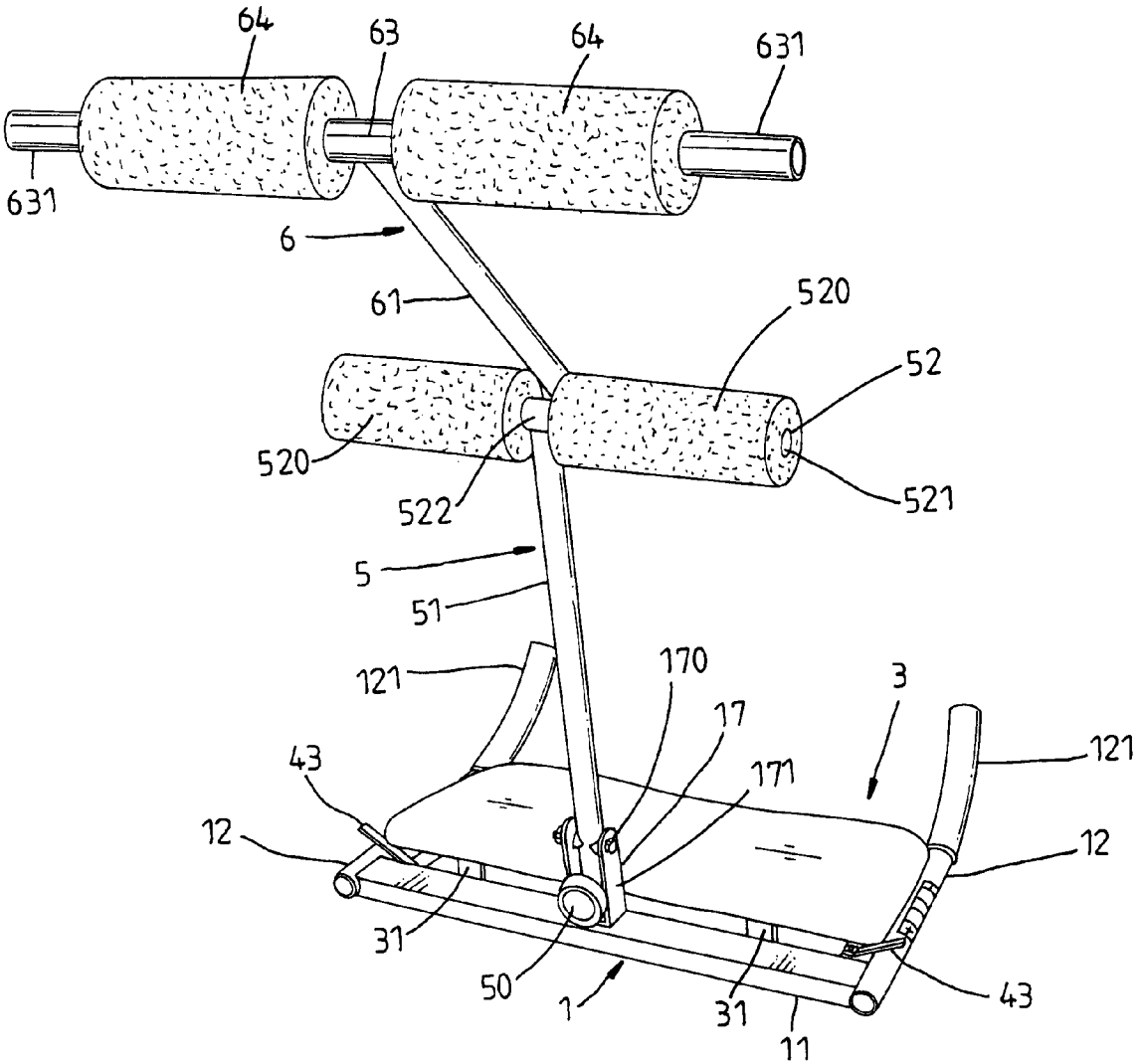
FIG. 5 is an oblique rear elevation of the folding collapsible exercising machine according to the present invention.
Figure 6:
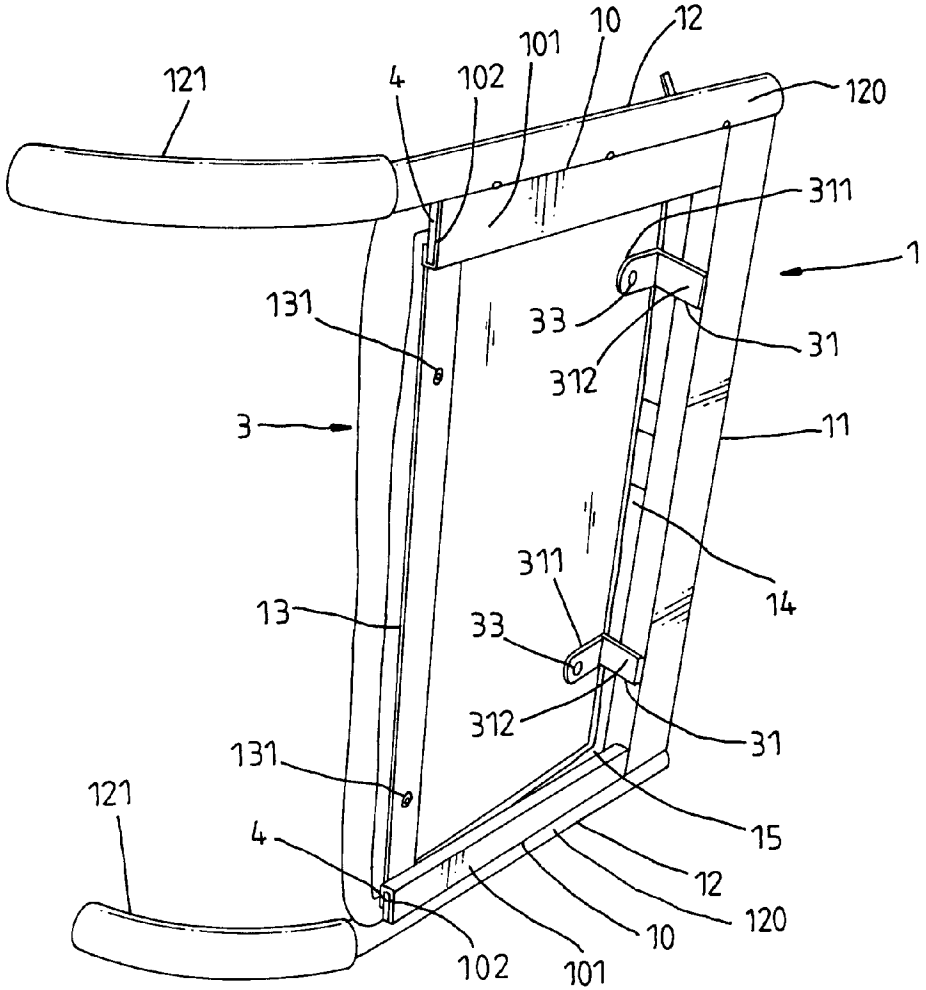
FIG. 6 is an enlarged scale of a part of the present invention, showing the bottom structure of the base frame of the folding collapsible exercising machine according to the present invention.
Figure 7:
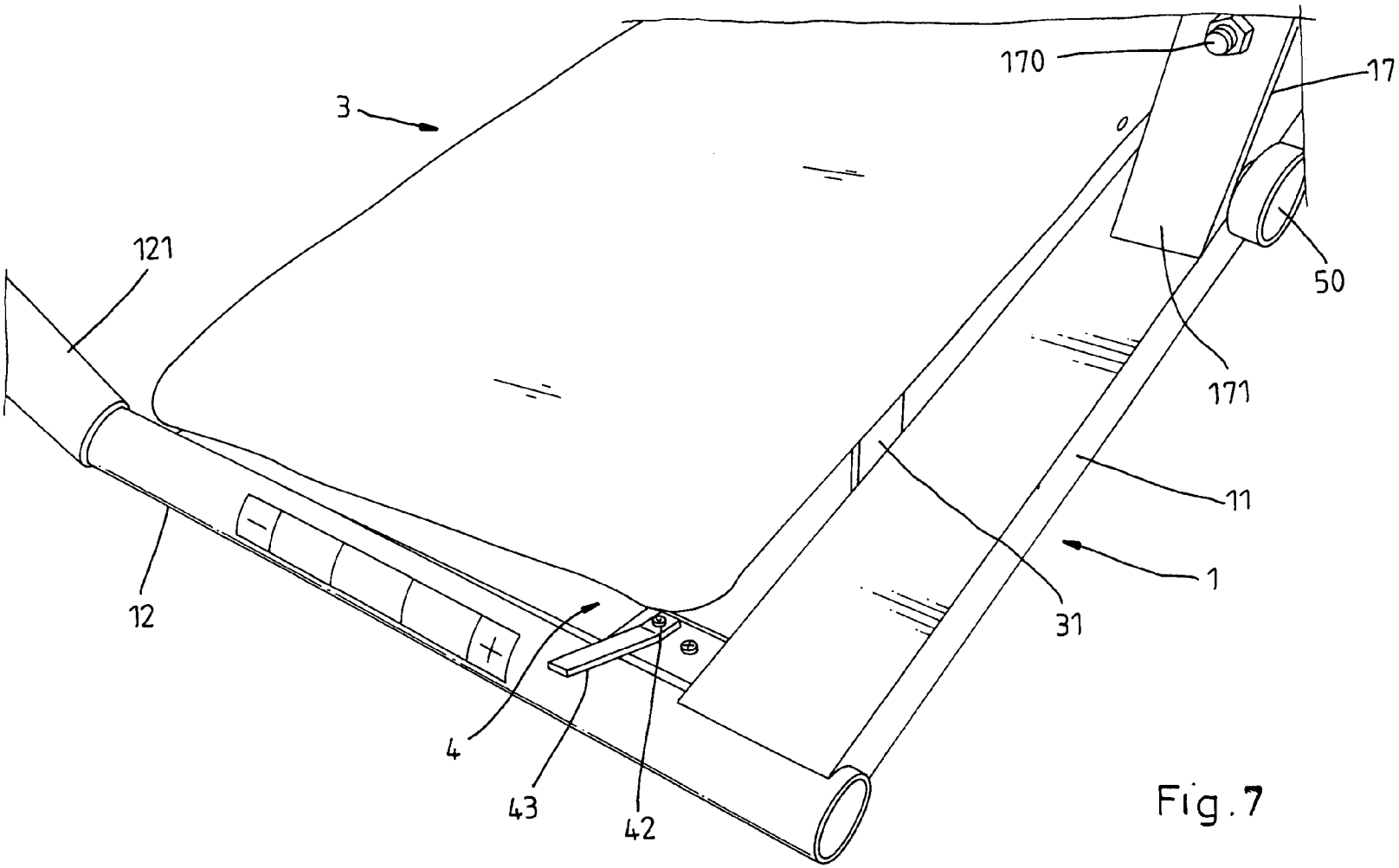
FIG. 7 is another enlarged view of the folding collapsible exercising machine according to the present invention.
Figure 8:
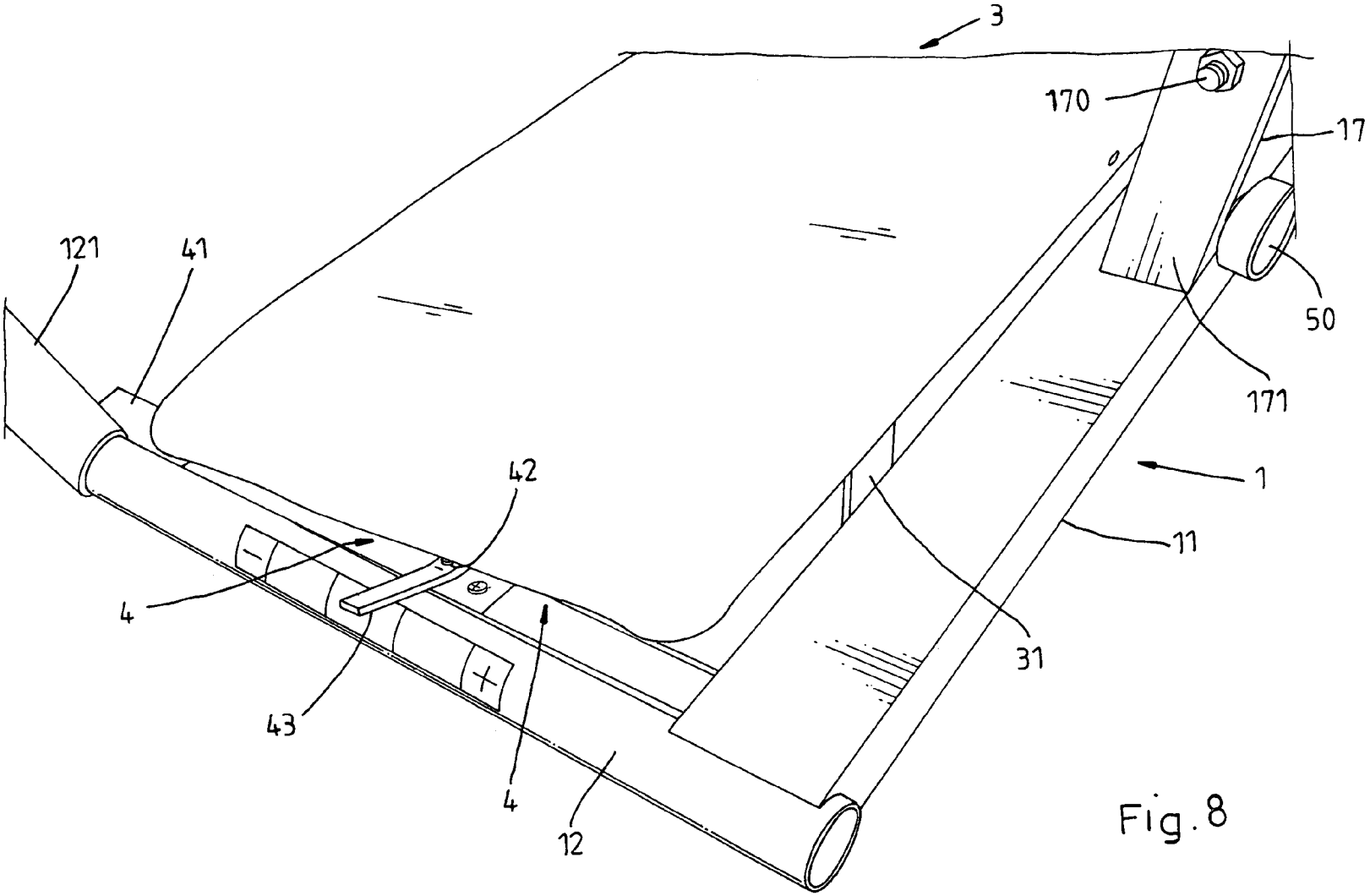
FIG. 8 corresponds to FIG. 7 but showing the position of the damping spring member adjusted.

Referring to FIGS. 4~8, a folding collapsible exercising machine in accordance with the present invention is shown comprising a base frame 1, a headrest 2 (see also FIGS. 10 and 11), a seat pad 3, two damping spring members 4, a leg extension bar 5, and a handlebar 6.

The base frame 1 comprises a front frame bar 11, two side frame bars 12 respectively extending from the two distal ends of the front frame bar 11 at right angles and arranged in parallel, each side frame bar 12 having the respective free end terminating in a smoothly arched endpiece 121, a rear frame bar 13 connected between the two side frame bars 12 on the middle (see FIG. 6), two rails 10 respectively fastened to the side frame bars 12 with the bottom side 101 of each of the rails 10 kept in flush with the bottom side 120 of each of the side frame bars 12 for supporting the exercising machine on the floor, each rail 10 defining a sliding groove 102 for receiving the damping spring members 4, and an upright support 17 upwardly extending from the front frame bar 11 on the middle. The upright support 17 has two sidewalls 171, a front wall 172 connected between the two sidewalls 171, and a screw hole 1720 formed in the front wall 172.

The seat pad 3 has the rear bottom side thereof fixedly fastened to the rear frame bar 13 of the base frame 1 with fastening elements 131, the front bottom side thereof fixedly fastened to one end 311 of each of a plurality of angle plates 31 with a respective fastening element 33. The other end 312 of each of the angle plates 31 is respectively fixedly connected to the front frame bar 11 of the base frame 1. Therefore, the seat pad 3 is supported on the base frame 1 in a backward sloping position. After installation of the seat pad 3 in the base frame 1, gaps 14 and 15 are defined between the front side of the seat pad 3 and the front frame bar 11 and between the two opposite lateral sides of the seat pad 3 and the two side frame bars 12.

The damping spring members 4 can be made of resilient steel material or glass fibers and are respectively slidably mounted in the sliding grooves 102 of the rails 10 (see FIGS. 6 and 7), each having handle 43 fixedly fastened to the front end 41 thereof with a fastening element 42. The handles 43 of the damping spring members 4 respectively extend through the gaps 15 between the two opposite lateral sides of the seat pad 3 and the two side frame bars 12 of the base frame 1. When moved the damping spring members 4 toward the rear side of the exercising machine (see FIG. 8), the front ends 41 of the damping spring members 4 are respectively extended out of the respective sliding grooves 102 of the rails 10.

The leg extension bar 5 is a substantially T-shaped bar comprising a vertical shaft 51 and a horizontal shaft 52. The vertical shaft 51 has the bottom end 510 pivotally connected to the upright support 17 of the base frame 1 with a pivot 170 for enabling the leg extension bar 5 to be turned relative to the base frame 1 between the operative position shown in FIGS. 4 and 5 where the leg extension bar 5 extends upwards from the base frame 1 and the non-operative position shown in FIG. 10 where the leg extension bar 5 is closely attached with the handlebar 6 to the seat pad 3 and the base frame 1. The bottom end 510 of the vertical shaft 51 is also provided with a locating hole 511 below the pivot 170. The threaded shank 501 of a lock screw 50 may be threaded into the screw hole 1720 in the front wall 172 of the upright support 17 and the locating hole 511 of the vertical shaft 51 to lock the leg extension bar 5 in the operative position. The other end, namely, the top end of the vertical shaft 51 is fixedly connected to the midpoint of the horizontal shaft 52. The horizontal shaft 52 has a front lug 53 on the middle and two cylindrical cushions 520 wrapping about the periphery of two ends 521 for supporting the user's legs comfortably.

Figure 9:
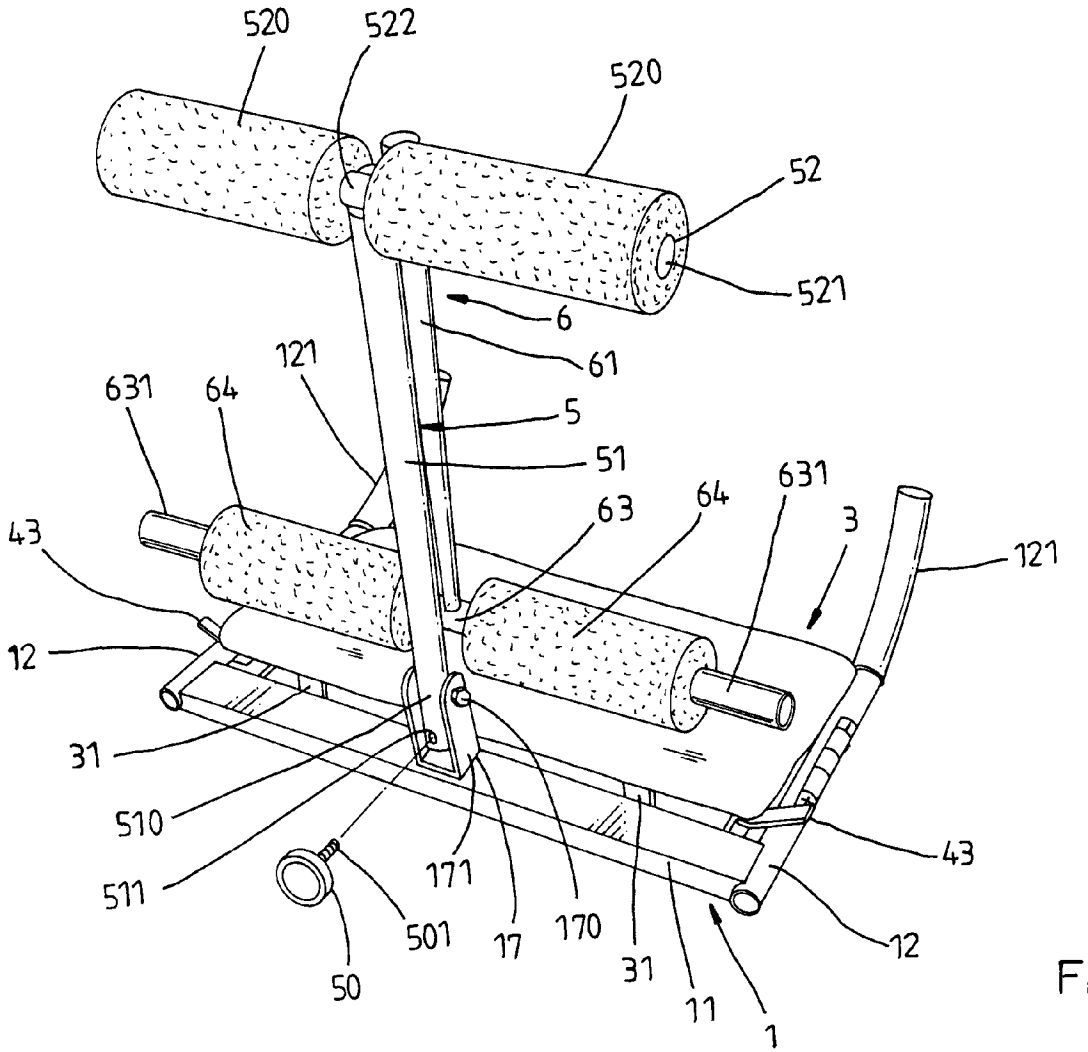
FIG. 9 is a schematic drawing showing the folding operation of the folding collapsible exercising machine according to the present invention.

The handlebar 6 is a substantially T-shaped bar comprising a longitudinal rod 61 and a transverse rod 63. The longitudinal rod 61 is perpendicularly extending from the midpoint of the transverse rod 63 and terminates in a coupling portion 611, which is pivotally connected to the front lug 53 of the horizontal shaft 52 of the leg extension bar 5 with a pivot 531. The transverse rod 63 is covered with two cylindrical cushions 64, having two ends 631 respectively extended out of the cylindrical cushions 64 for the holding of the hands. When installed, the handlebar 6 can be turned relative to the leg extension bar 5 between the operative position shown in FIGS. 4 and 5 where the handlebar 6 extends obliquely upwards and supported on a middle part 522 of the horizontal shaft 52, and the non-operative position shown in FIGS. 9 and 10 where the handlebar 6 is closely attached to the leg extension bar 5.

Figure 15:
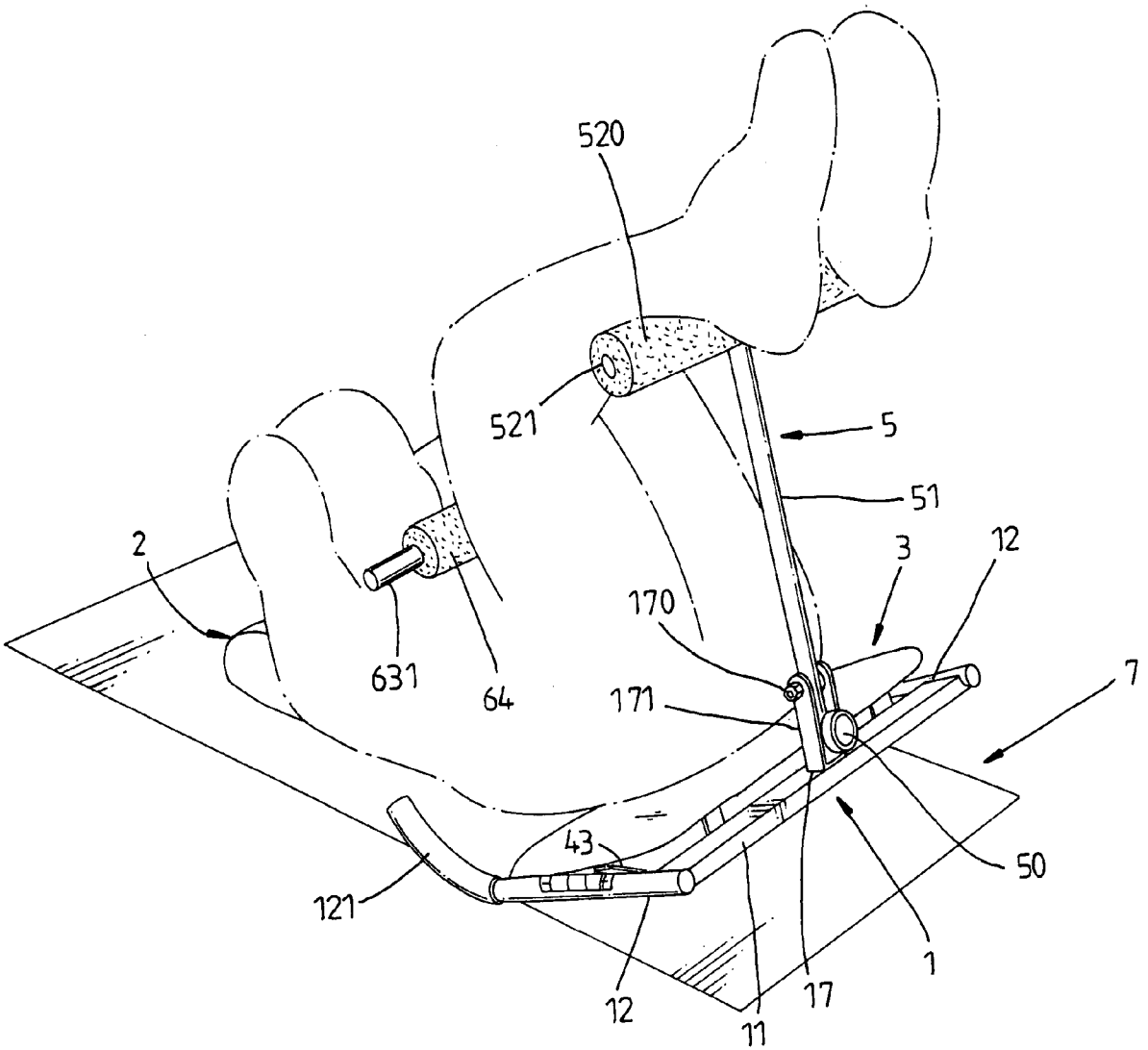
FIG. 15 is a schematic drawing showing still another operation status of the folding collapsible exercising machine according to the present invention.
Figure 16:
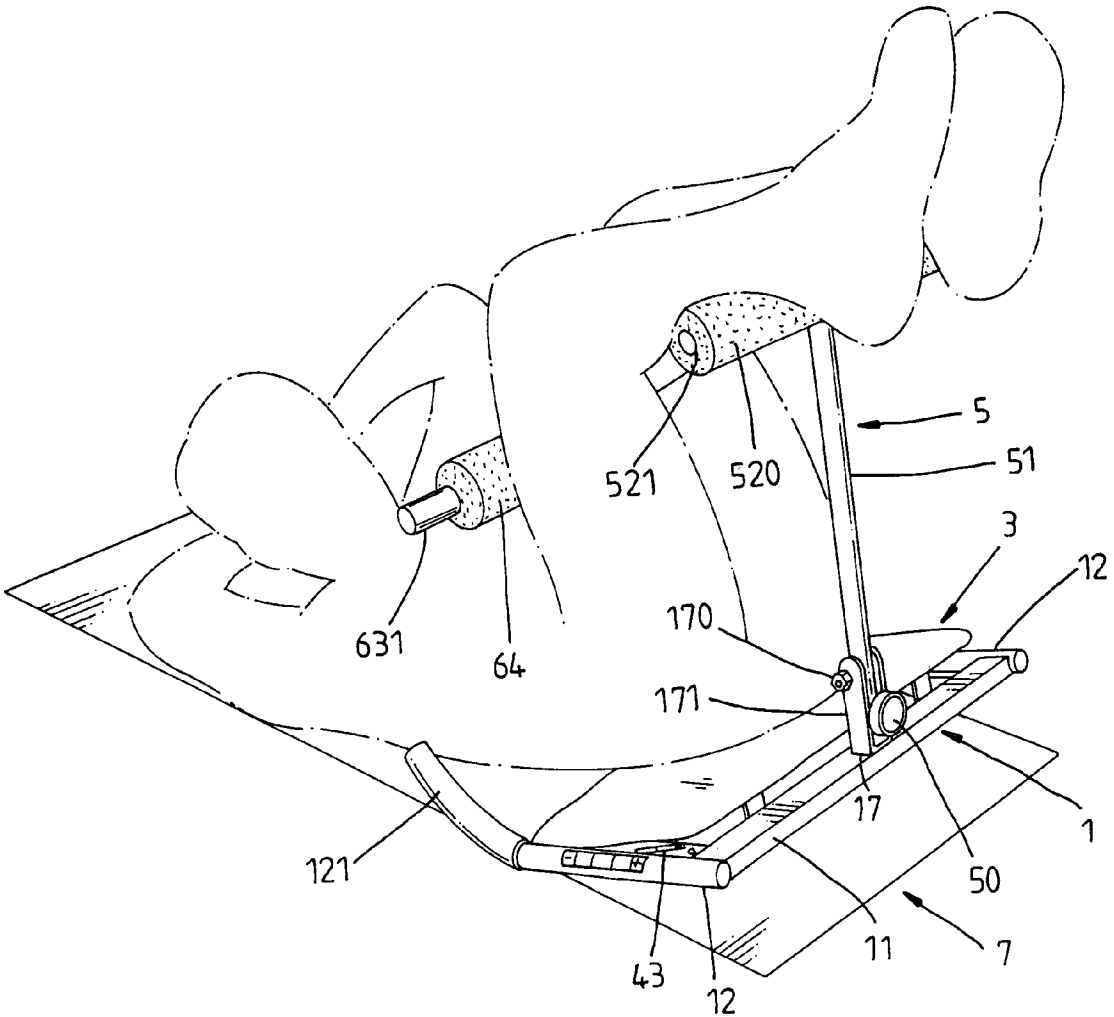
FIG. 16 is a schematic drawing showing still another operation status of the folding collapsible exercising machine according to the present invention.
Figure 17:
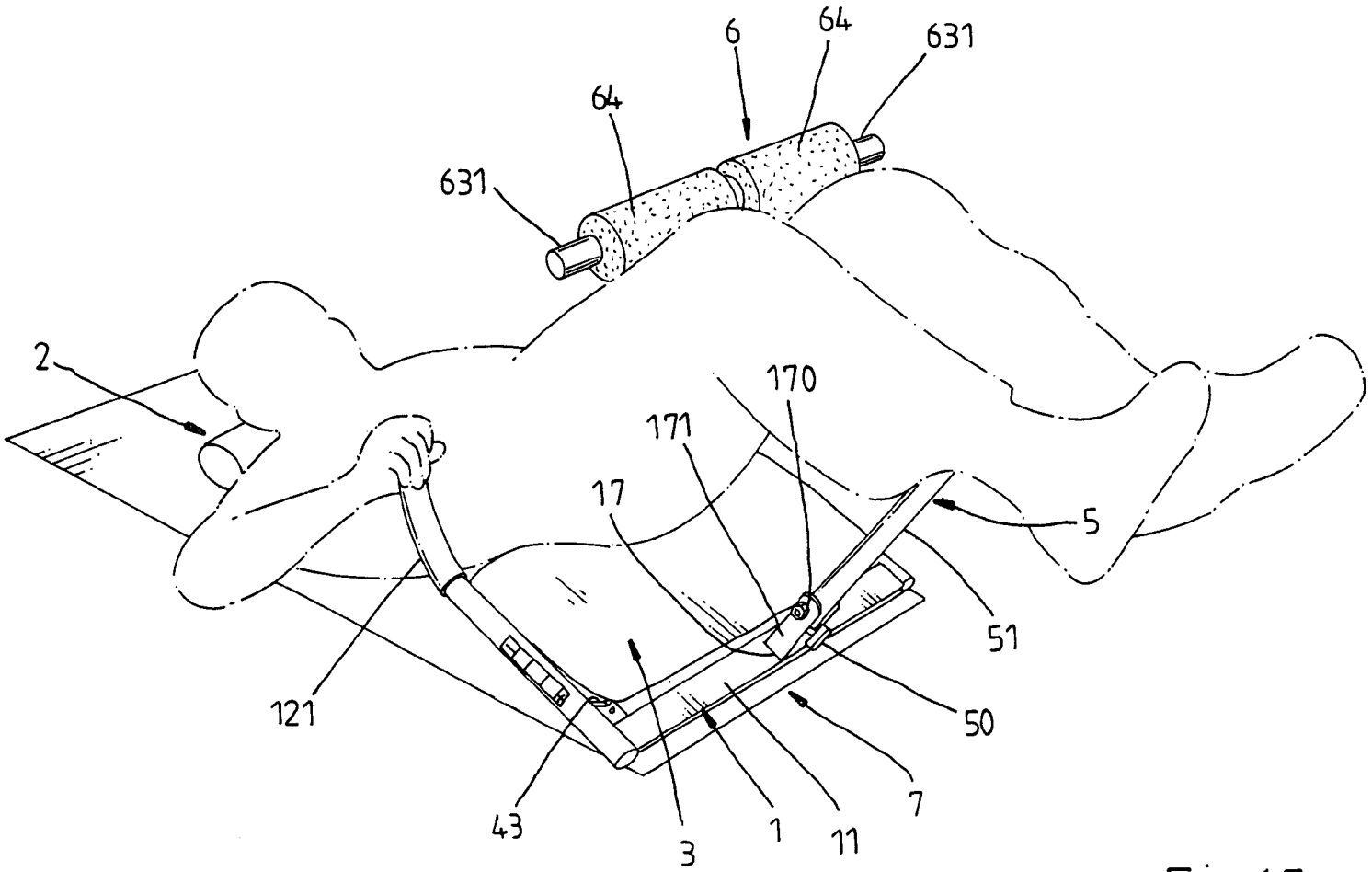
FIG. 17 is a schematic drawing showing still another operation status of the folding collapsible exercising machine according to the present invention.

When in use, the folding collapsible exercising machine can be placed on a mattress 7 on the floor, and then the user can sit on the seat pad 3 (see FIG. 11) with the legs rested on the cylindrical cushions 520 and the hands holding the ends 631 of the transverse rod 63 of the handlebar 6, and then the user can turn the upper part of the body backwards and lie the back on the mattress 7 to rock the base frame 1 (see FIGS. 11~14), or to perform sit-up exercise (see FIGS. 15 and 16), so as to train the muscles of the legs, chest and abdomen. Further, the headrest 2 can be put on the mattress 7 for supporting the user's head during exercise. Further, through the handles 43, the user can pull the damping spring members 4 out of the sliding grooves 102 of the respective rails 10 to the desired distance (see FIG. 8) to adjust the damping resistance to the rocking of the smoothly arched endpieces 121 of the side frame bars 12 of the base frame 1 over the floor. Further, the user can rest the legs on the cylindrical cushions 520 of the leg extension bar 5 and holds the smoothly arched endpieces 121 of the side frame bars 12 of the base frame 1 with the hands, and then exercise back-band.

Figure 10:
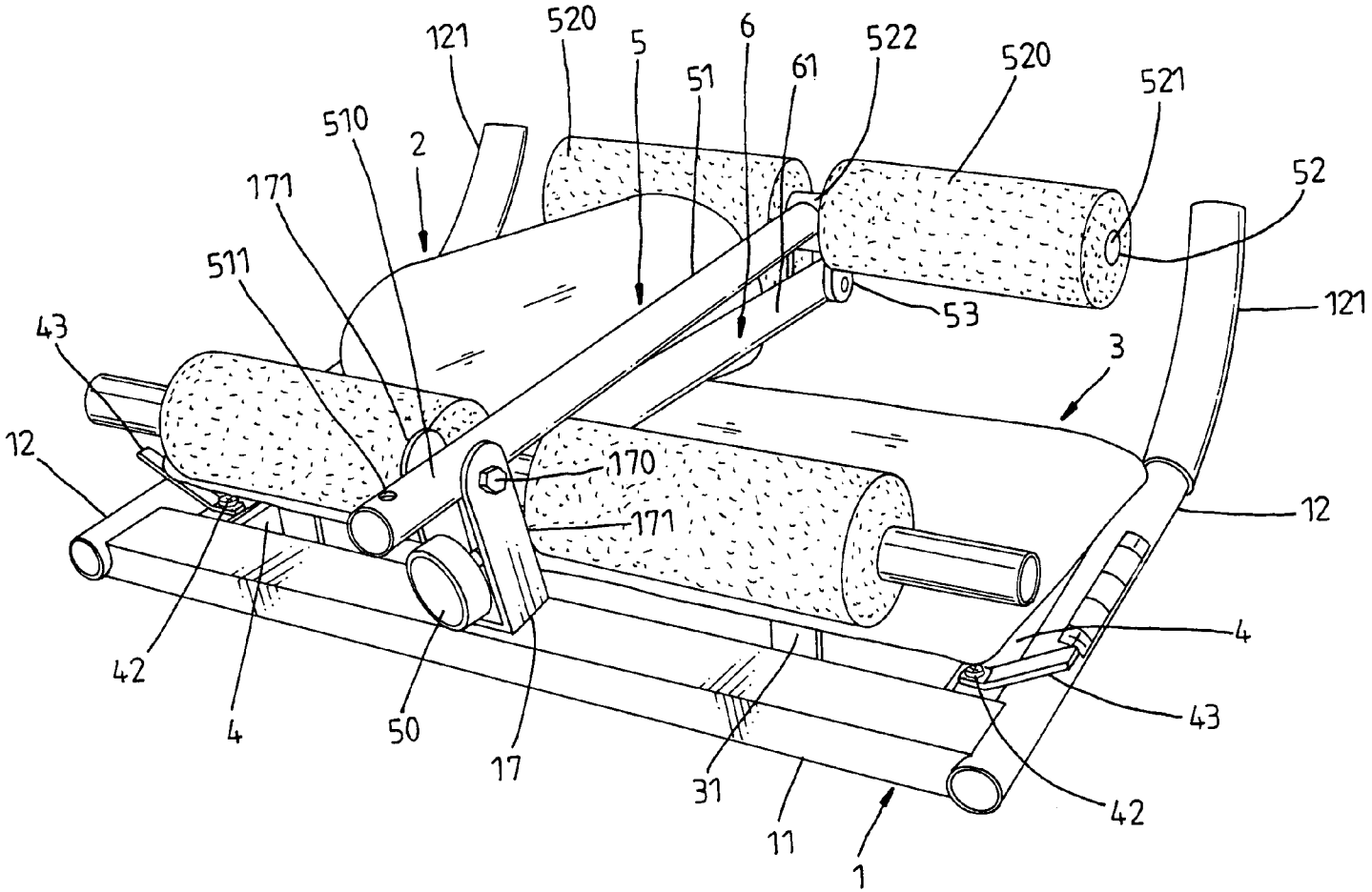
FIG. 10 is an elevational view of the present invention, showing the folding collapsible exercising machine collapsed.
Figure 11:
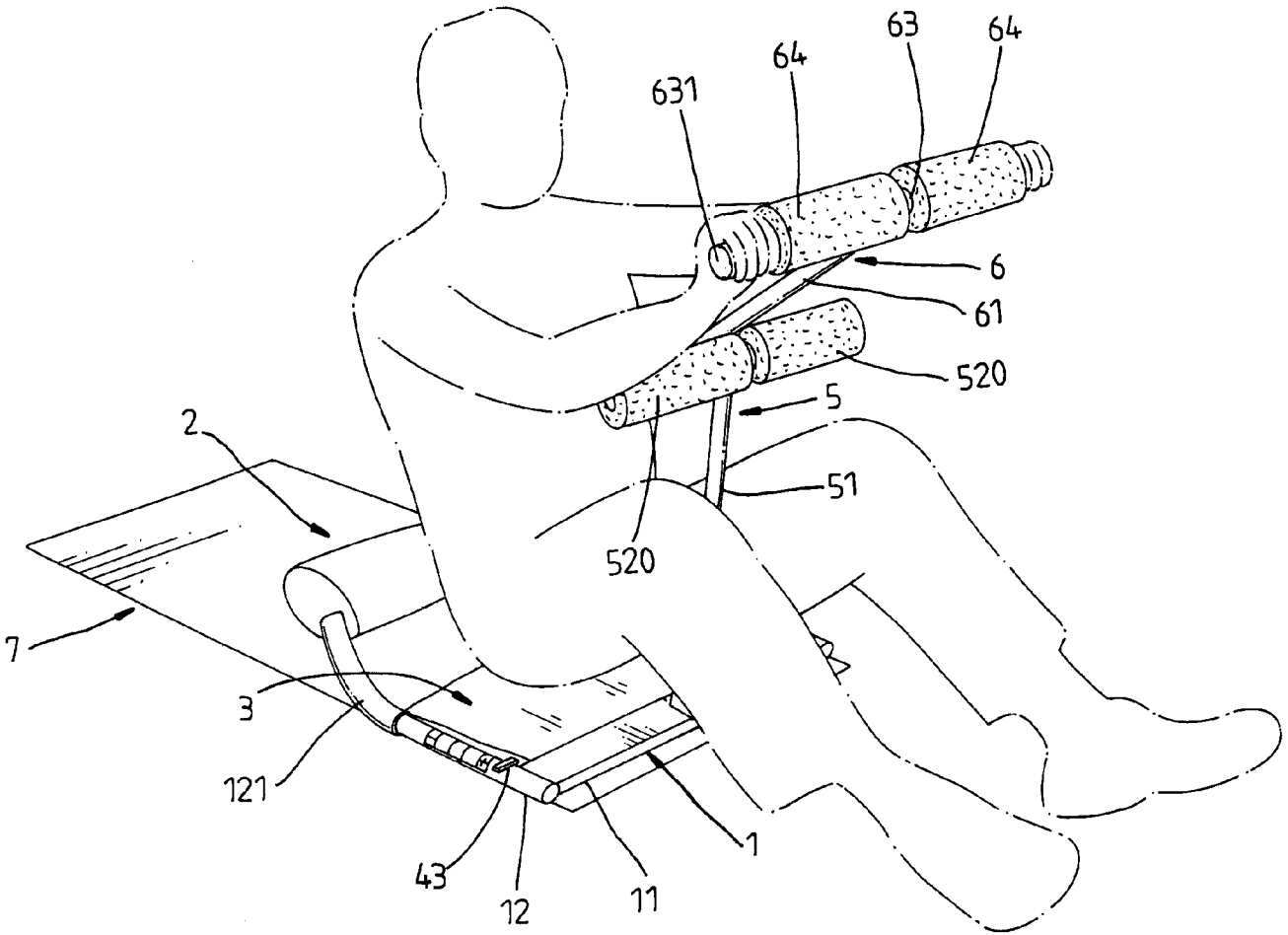
FIG. 11 is a schematic drawing showing an operation status of the folding collapsible exercising machine according to the present invention.
Figure 12:
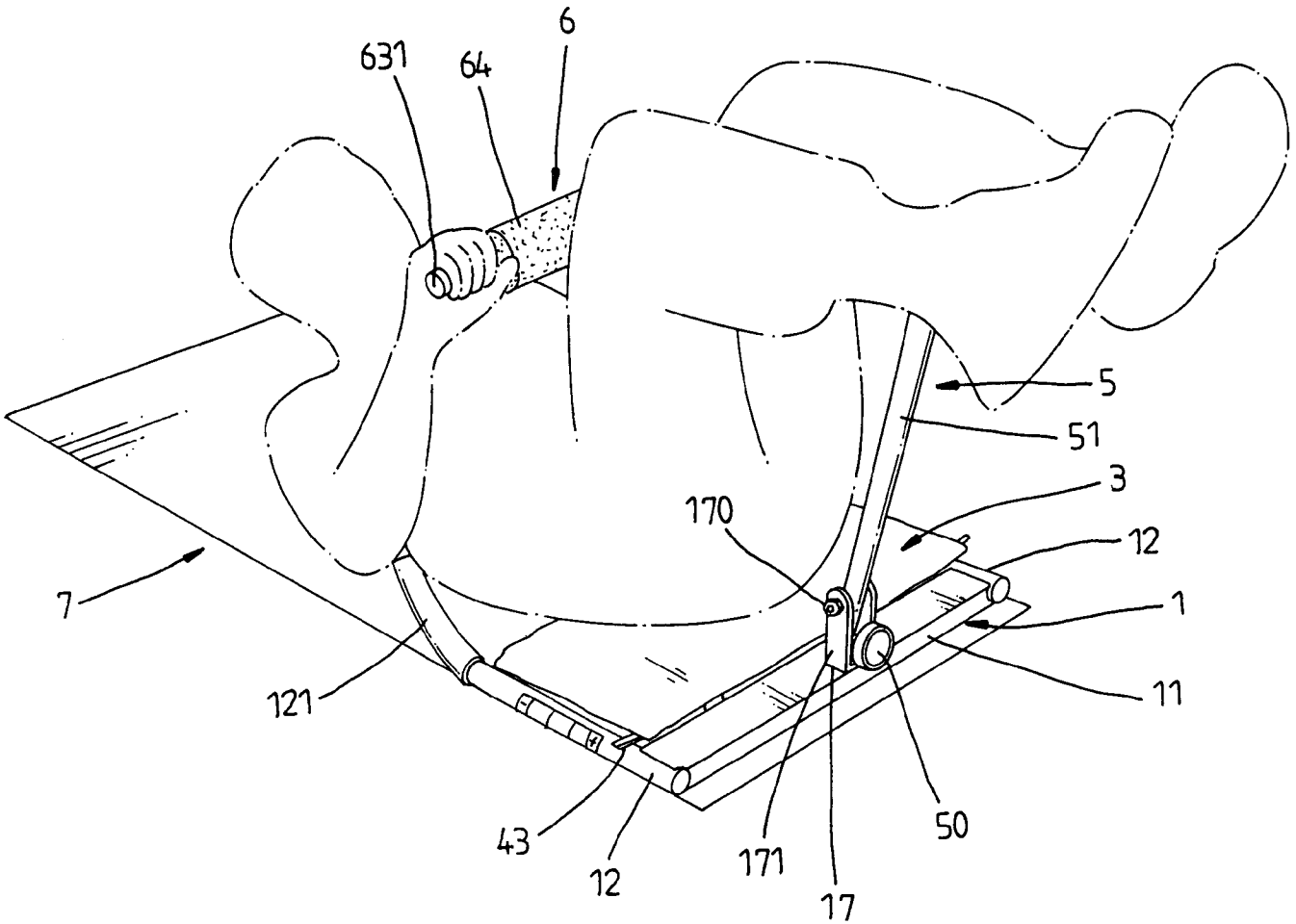
FIG. 12 is a schematic drawing showing another operation status of the folding collapsible exercising machine according to the present invention.
Figure 13:
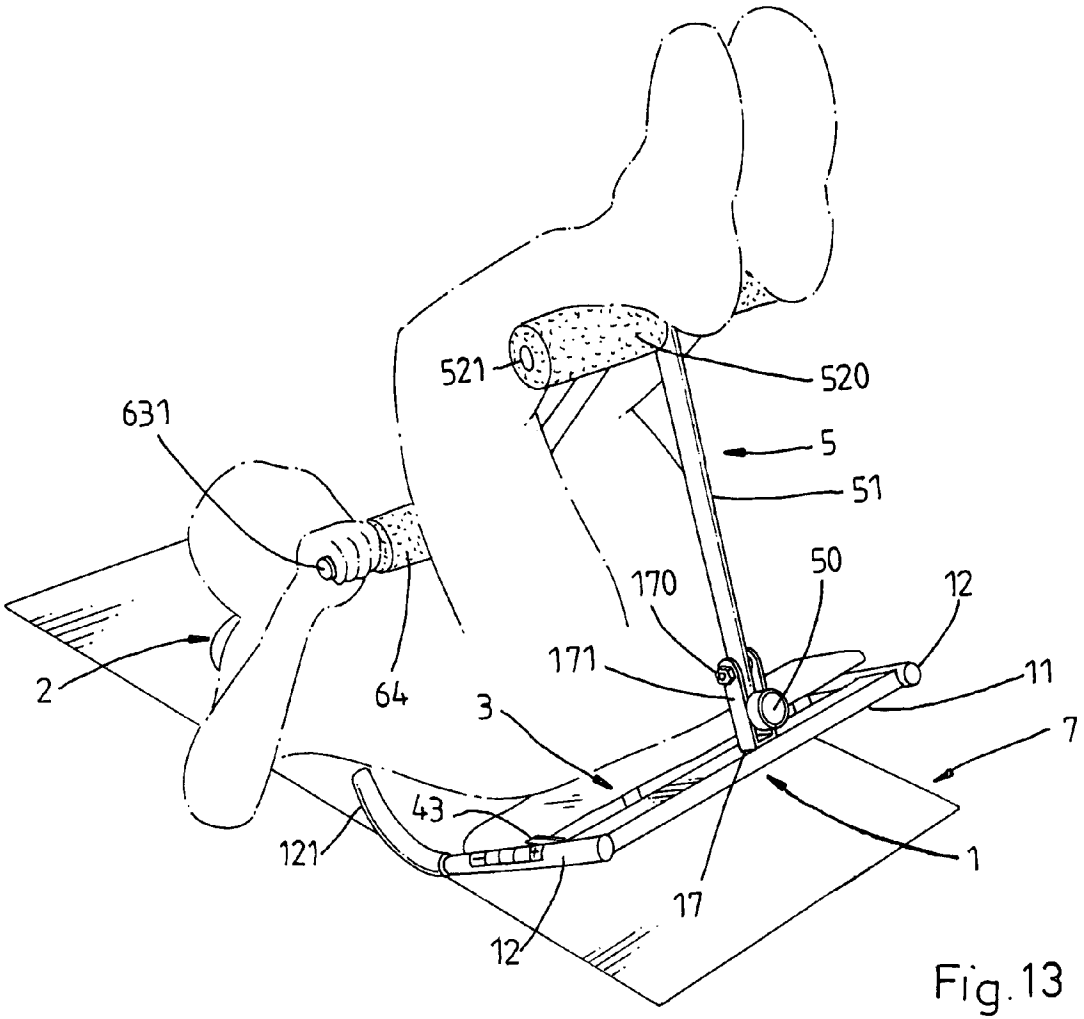
FIG. 13 is a schematic drawing showing still another operation status of the folding collapsible exercising machine according to the present invention.
Figure 14:
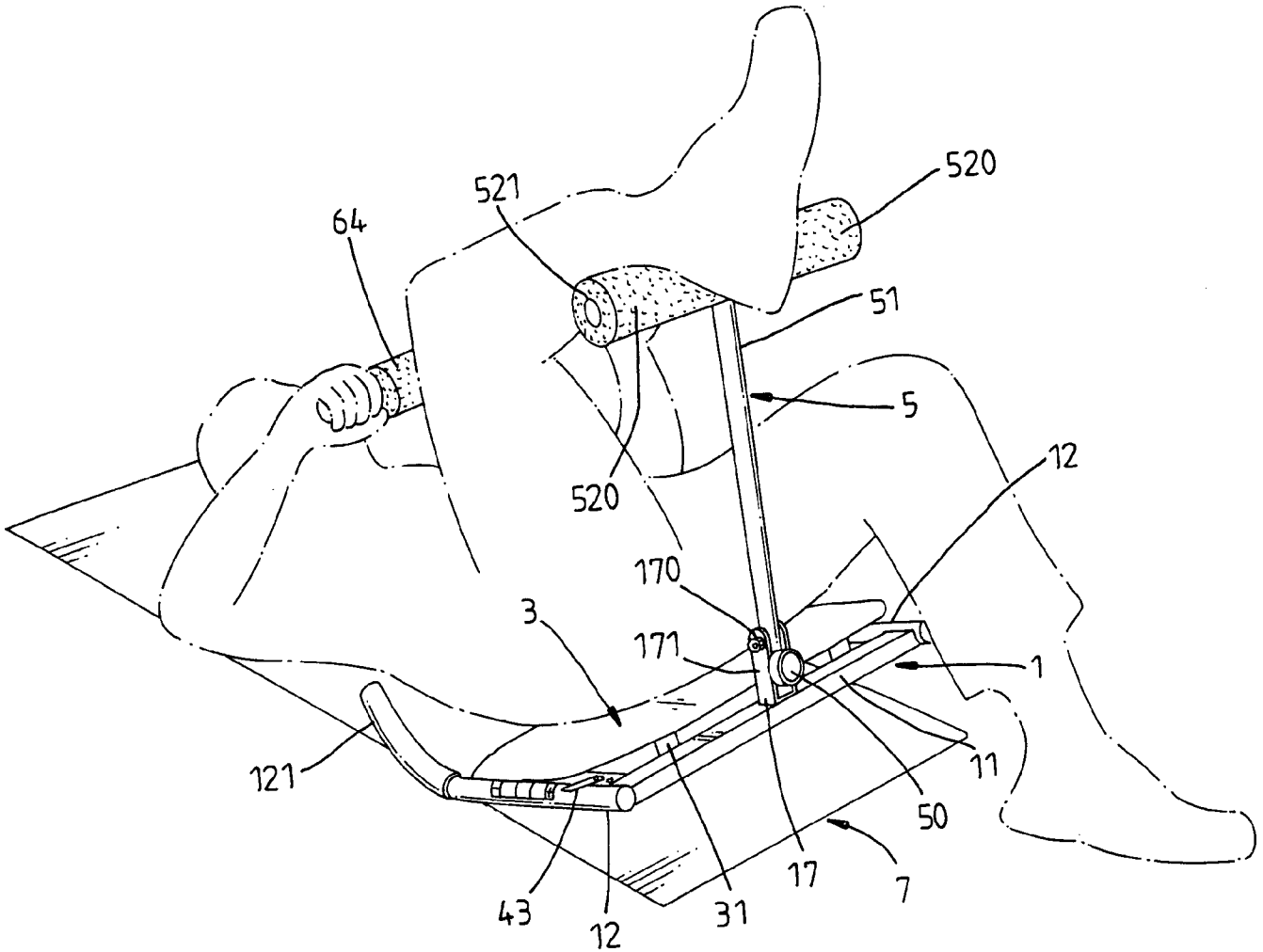
FIG. 14 is a schematic drawing showing still another operation status of the folding collapsible exercising machine according to the present invention.

When not in use, the handlebar 6 is turned forwardly downwards and received to the leg extension bar 5, and then the lock screw 50 is removed from the vertical shaft 51 of the leg extension bar 5 and the upright support 17 of the base frame 1 (see FIG. 9), and then the handlebar 6 with the leg extension bar 5 are turned forwardly downwards and closely attached to the seat pad 3 and the base frame 1, and then the headrest 2 is put on the seat pad 3 between the cylindrical cushions 64 of the handlebar 6 and the cylindrical cushions 520 of the leg extension bar 5 (see FIG. 10).

Although a particular embodiment of the present invention has been described in detailed for purposes of illustration, various modifications and enhancements may be made without departing from the spirit and scope of the invention. Accordingly, the invention is not to be limited except as by the appended claims.

What is claimed is:

1. A folding collapsible exercising machine comprising:

a base frame, said base frame comprising a front frame bar, two side frame bars respectively extending from two distal ends of said front frame bar at right angles and arranged in parallel, said side frame bars each having a respective free end terminating in a smoothly arched endpiece for enabling said base frame to rock on the floor, a rear frame bar connected between said two side frame bars, two rails respectively fastened to said side frame bars in flush with a bottom side of each of said side frame bars for supporting the folding collapsible exercising machine on a floor, said rails each having a sliding groove, and an upright support upwardly extending from a middle part of said front frame bar, said upright support having two sidewalls, a front wall connected between said two sidewalls, and a screw hole formed in said front wall;

a seat pad, said seat pad having a rear bottom side thereof fixedly fastened to said rear frame bar of said base frame and a front bottom side connected to said front frame bar of said base frame;

two angle plates respectively connected between the front bottom side of said seat pad and said front frame bar of said base frame to support said seat pad in a sloping position;

two damping spring members respectively slidably mounted in the sliding grooves of said rails and adapted to impart a damping resistance to said base frame when rocking said base frame on the floor, said damping spring members each having a handle fixedly fastened to a front end thereof for grasping with the hand to move the respective damping spring member in and out of the respective sliding groove to adjust the damping resistance;

a leg extension bar, said leg extension bar comprising a horizontal shaft, two cylindrical cushions wrapped about the periphery of said horizontal shaft, said horizontal shaft having a front lug on the middle, and a vertical shaft perpendicularly extending from a middle part of said horizontal shaft and pivotally connected to said upright support of said base frame for enabling said leg extension bar to be turned relative to said base frame between a first position where said vertical shaft is in vertical alignment with said upright support of said base frame and a second position where said leg extension bar is closely attached to said seat pad, said vertical shaft having a locating hole in a bottom end thereof;

a lock screw for threading into the screw hole in the front wall of said upright support of said base frame and the locating hole of the vertical shaft of said leg extension bar to lock said leg extension bar in said first position; and a handlebar, said handlebar comprising a transverse rod, and a longitudinal rod perpendicularly extending from a middle part of said transverse rod and pivotally connected to the front lug of said horizontal shaft of said leg extension bar for enabling said handlebar to be turned relative to said leg extension bar between an extended position where said longitudinal rod is supported on said horizontal shaft of said leg extension bar and a received position where said handlebar is closely attached to the vertical shaft of said leg extension bar.

* * * * *